US006347600B1

(12) United States Patent
Duff, II

(10) Patent No.: US 6,347,600 B1
(45) Date of Patent: Feb. 19, 2002

(54) PORTABLE INDICATING AND PROTECTIVE STRUCTURE FOR UNDERGROUND UTILITIES

(76) Inventor: John T. Duff, II, 8289 Station House Rd., Centerville, OH (US) 45458

( * ) Notice: Subject to any disclaimer, the term of this patent is extended or adjusted under 35 U.S.C. 154(b) by 17 days.

(21) Appl. No.: 09/588,341

(22) Filed: Jun. 6, 2000

Related U.S. Application Data

(60) Provisional application No. 60/138,600, filed on Jun. 11, 1999.

(51) Int. Cl.[7] ..... G09F 17/00

(52) U.S. Cl. ..... 116/209; 248/530; 40/604; 40/606

(58) Field of Search ..... 116/209, 173, 116/63 C, 63 P, 63 R; 248/530, 531, 532, 533, 512, 99, 156; 40/603, 604, 606, 610; 52/103

(56) References Cited

U.S. PATENT DOCUMENTS

| | | | | | |
|---|---|---|---|---|---|
| 1,382,115 | A | * | 6/1921 | Ohme | 248/156 |
| 1,473,040 | A | | 11/1923 | Harris | |
| 1,615,611 | A | * | 1/1927 | Bindon | 248/156 |
| 1,722,197 | A | | 7/1929 | Carnoe | |
| 2,121,379 | A | | 6/1938 | Young | |
| 2,127,930 | A | | 8/1938 | Osborn | |
| 2,393,126 | A | | 1/1946 | Stevenson | |
| 2,509,284 | A | * | 5/1950 | Allen | 248/156 |
| 3,037,311 | A | | 6/1962 | Ross et al. | |
| 3,160,380 | A | * | 12/1964 | Blades | 248/156 |
| 4,312,600 | A | | 1/1982 | Schaaf et al. | |
| 4,402,166 | A | * | 9/1983 | Wortham, Jr. | 248/156 |
| 4,738,060 | A | | 4/1988 | Marthaler et al. | |
| 4,908,249 | A | | 3/1990 | Lines | |
| 5,215,399 | A | | 6/1993 | Berger | |
| 5,303,961 | A | | 4/1994 | Popil | |
| 5,377,944 | A | | 1/1995 | Getsinger | |
| 5,394,645 | A | | 3/1995 | Wilson | |
| 5,467,548 | A | | 11/1995 | Ross | |
| 5,599,132 | A | | 2/1997 | Hughes, Jr. | |
| 6,082,157 | A | * | 7/2000 | Boyce | 248/530 |

* cited by examiner

*Primary Examiner*—Andrew H. Hirshfeld
(74) *Attorney, Agent, or Firm*—Tom Hamill, Jr.

(57) ABSTRACT

A portable indicating and protective structure for underground utilities is provided. The portable structure is designed to be erected about a utility located at ground level on a construction site, to permit construction workers to avoid inadvertent damage to such a utility. Such damage occurs when the utility is impacted by construction machinery, delivery trucks, and other vehicles on the construction site. The portable structure is a protective barrier which would enclose or encircle the utility. The sidewall elements may be secured in place by stakes or the like. The sidewall may be cylindrical, rectangular, or some other geometric configuration. The top portion and the lower portion would be open to permit access to the utility. Two poles will be affixed proximal the sidewall and will extend vertically several times the height of the sidewall. These pole elements may secure the sidewall in place by passing vertically through a plurality of ring elements which are connected to the sidewall. A brightly colored banner will be located intermediate the two poles, a first side of the banner being connected to the first pole, a second side of the banner being connected to the second pole. The banner may include identifying indicia, indicating the nature of the utility located there below. Such a structure would clearly indicate the location of the utility and deter accidental damage to the utility.

10 Claims, 4 Drawing Sheets

PORTABLE INDICATING AND PROTECTIVE STRUCTURE FOR UNDERGROUND UTILITIES

This application claim benefit to provisional application No. 60/138,600 Jun. 11, 1999.

BACKGROUND OF THE INVENTION

1. Field of the Invention

The present invention relates generally to physical indicator devices and more particularly to a temporary structure which would surround a ground based utility on a construction site, to clearly indicate the utilities location.

2. Description of the Prior Art

A patent search at U.S. Patent Office located the following reference:

| |
|---|
| U.S. Pat. No. 1,473,040 |
| U.S. Pat. No. 1,722,197 |
| U.S. Pat. No. 2,121,379 |
| U.S. Pat. No. 2,127,930 |
| U.S. Pat. No. 2,393,126 |
| U.S. Pat. No. 3,037,311 |
| U.S. Pat. No. 4,312,600 |
| U.S. Pat. No. 4,738,060 |
| U.S. Pat. No. 4,908,249 |
| U.S. Pat. No. 5,215,399 |
| U.S. Pat. No. 5,303,961 |
| U.S. Pat. No. 5,377,944 |
| U.S. Pat. No. 5,394,645 |
| U.S. Pat. No. 5,467,548 |
| U.S. Pat. No. 5,599,132 |

None of these references, either singly or in combination, disclose the instant invention.

SUMMARY OF THE INVENTION

It is commonplace to install utilities prior to the commencement or very early in the commencement of construction at a construction site. These utilities are exposed to various hazards throughout the construction process. Such utilities include, but are not limited to, water meter pits, water valve pits, natural gas shut off valves, electric pedestals, communication pedestals, and sewer manholes. Other hazards, such as deep holes, hazardous materials, or equipment may also be in danger of damage or causing injury. Such devices and utilities are very difficult to see as they are at ground level, and are also very easy to damage. The most common form of damage occurs when a vehicle, construction machine, or delivery truck impact the utility. It has been determined that a need to indicate the location of such a ground based structure is required. As such, a portable indicating and protective structure for underground utilities is provided. The portable structure is designed to be erected about a utility located at ground level on a construction site, to permit construction workers to avoid inadvertent damage to such a utility. Such damage occurs when the utility is impacted by construction machinery, delivery trucks, and other vehicles on the job site. The portable structure is a protective barrier which would enclose or encircle the utility. The sidewall elements may be secured in place by stakes or the like. The sidewall may be cylindrical, rectangular, or some other geometric configuration. The top portion and the lower portion would be open to permit access to the utility. Two poles will be located proximal the sidewall and will extend vertically several times the height of the sidewall.

These pole elements may secure the sidewall in place by passing vertically through a plurality of ring elements which are connected to the sidewall. A brightly colored banner will be located intermediate the two poles, a first side of the banner being connected to the first pole, a second side of the banner being connected to the second pole. The banner may include identifying indicia, indicating the nature of the utility located there below. The banner may be a flexible strip comprised of fabric or plastic, or it may be a more substantial structure, comprised of strong plastic, wood or other such substantial materials. Such a structure would clearly indicate the location of the utility and deter accidental damage to the utility.

The portable indicating structure for utilities, hereafter referred to as a utility guard, has several salient features. The utility guard may be constructed of a plurality of materials, including, but not limited to, wood, metal, plastic, composite materials etcetera. The materials would be chosen for their ease of employment, strength, portability, and ability to withstand vehicular or other accidental impacts. These materials may be brightly colored or include reflective coatings or attachments to enhance their visibility in low light conditions.

The utility guard's central barrier's shape and size will be dependent on the ground based utility structure it is protecting, the size of that structure and the structures location. In a preferred embodiment, the utility guard's central barrier will be a corrugated, double walled, generally cylindrical, plastic pipe. The barrier may range from about one to four feet in diameter, and may range from about one to three feet in height. In the cylindrical embodiment, a first ring and second ring would be secured to the barrier sidewall in a vertical straight line, the first ring secured at about ¼ of the height of the barrier and the second ring at about ¾ of the height of the barrier. A third ring and a fourth ring would also be secured to the barrier sidewall, about 180 degrees from where the first ring and second ring are located. The third ring would also be secured at about ¼ of the height of the barrier, and the fourth ring would be also secured at about ¾ to proximal the top of the height of the barrier. Since both the first ring and second ring are in a straight vertical relation, they are able to permit a first rod to pass through both the first and second rings, and permit the first rod to be secured in the ground outside of the barrier in a stake like fashion. Similarly, since both the third ring and the fourth ring are in a straight line vertical relation, they are able to permit a second rod to pass through both the third and fourth rings, and permit the second rod to be secured in the ground outside the barrier in a stake like fashion. The rings may be secured to the sidewall by permitting an extending portion to pass through the sidewall and be conventionally secured thereto by a nut, bolt, wingnut or other fastener. It is to be understood that in some embodiments the ring portions may be disposed within the barrier.

The first and second rods secure the barrier in position about the ground based utility. Due to the placement of the rings, the first and second rod are 180 degrees apart from each other. The rods will at least extend several times the height of the barrier. A banner will be placed across the top of the rods, with a first side portion of the banner being connected to the first rod and a second side portion of the banner to be connected to the second rod. The banner will be manufactured from a weather resisting material, and may be chosen to be a bright or flourescent color to attract visual attention. The banner may include reflective portions thereon, to permit ease of viewing in low light periods. The banner may further receive indicia thereon, indication the type of utility located there below or that there is a structure to be avoided at that location. This indicia may be located on both the front side and the rear side of the banner.

Other embodiments of the utility guard may be square or rectangular. These embodiments would have poles, rods or rectangular wooden elements (2×4's, 2×2's etc) to be affixed to the sidewalls and to have a banner suspended therebetween. Methods to affix the sidewalls about the ground based utility will be provided. These could include stakes or other methods.

The portable indicating and protective structure for underground utilities may easily be set up, taken down or moved. No special tools or talents are required for its erection. Once in place, it will protect the underground utility or whatever it surrounds, from unintentional damage.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a portable indicating and protective structure for underground utilities which has a barrier for surrounding a utility, yet permits ease of access to that utility.

It is therefore an object of the present invention to provide a portable indicating and protective structure for underground utilities which may be easily erected, removed or moved.

It is therefore an object of the present invention to provide a portable indicating and protective structure for underground utilities which includes means to provide a banner, the banner bearing indicia indicating what type of utility is present, a general warning or an advertisement.

It is therefore an object of the present invention to provide a portable indicating and protective structure for underground utilities wherein the banner and the barrier may include a reflective surface or a reflective pattern on the surface.

It is therefore an object of the present invention to provide a portable indicating and protective structure for underground utilities which may be easily and efficiently manufactured and marketed.

It is a further objective of the present invention to provide It is therefore an object of the present invention to provide a portable indicating and protective structure for underground utilities which is of durable and reliable construction.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiment of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
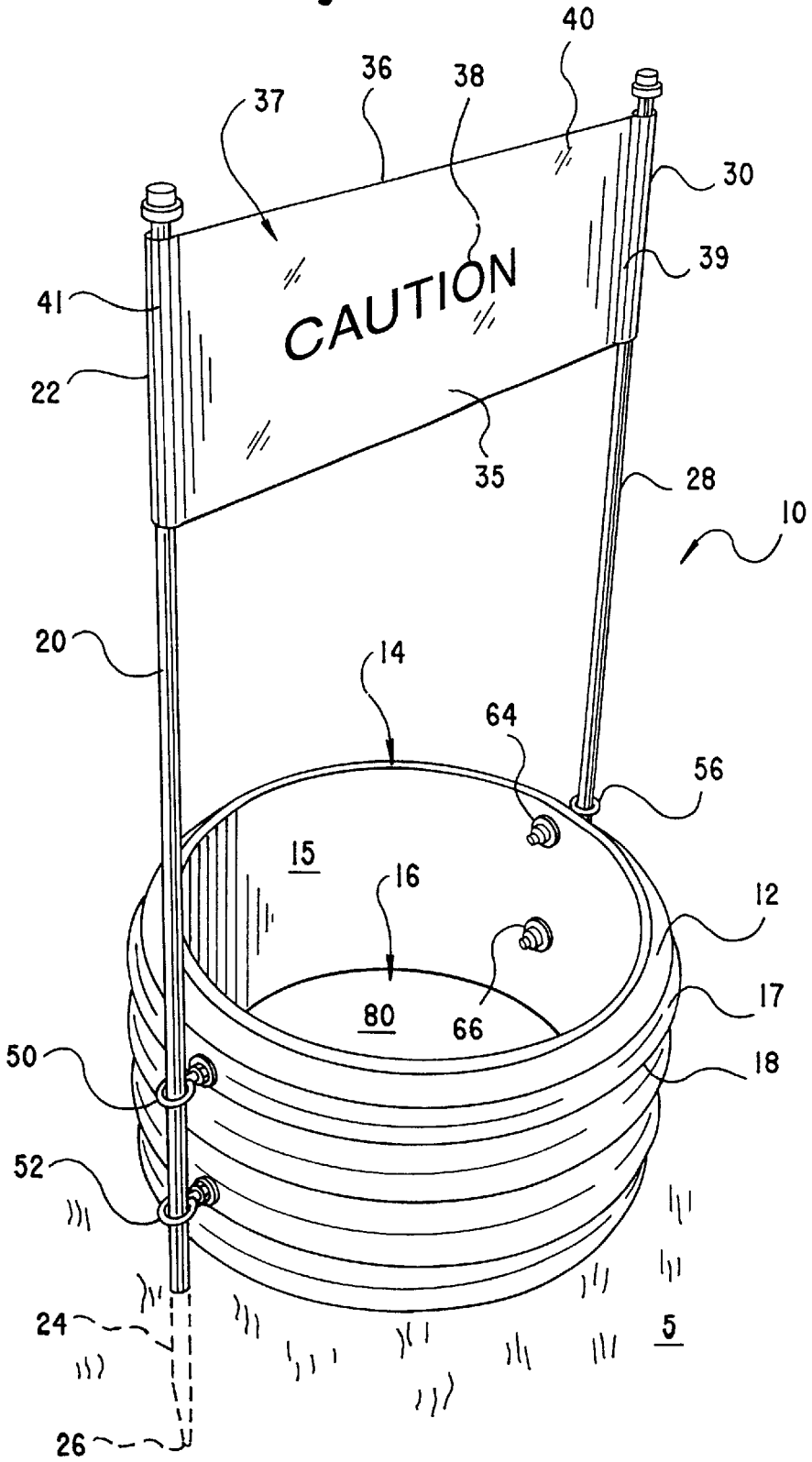
FIG. 1 is a perspective view of the portable indicating and protective structure for underground utilities.
Figure 2:
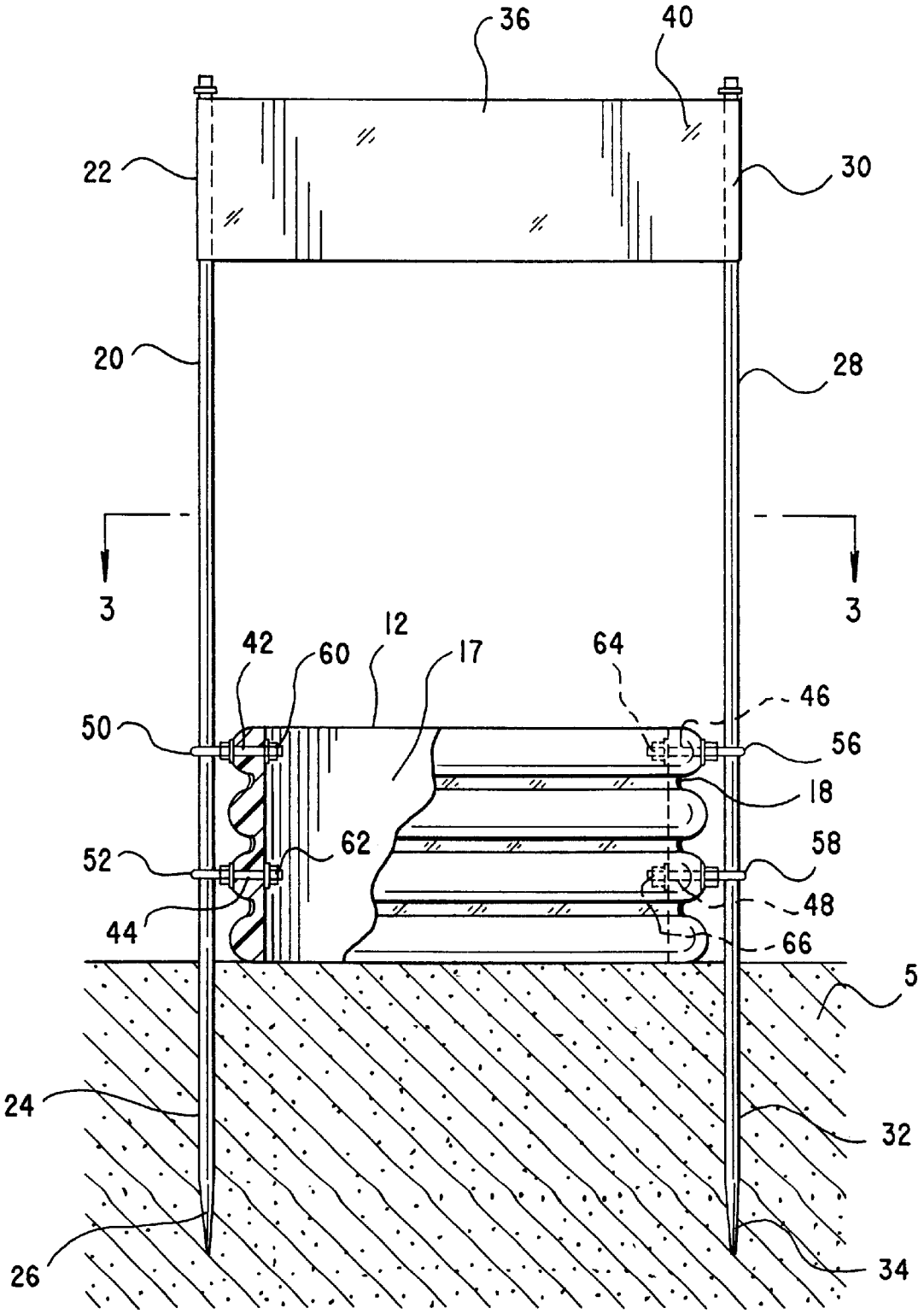
FIG. 2 is a side view including a cutaway view of the portable indicating and protective structure for underground utilities.
Figure 3:
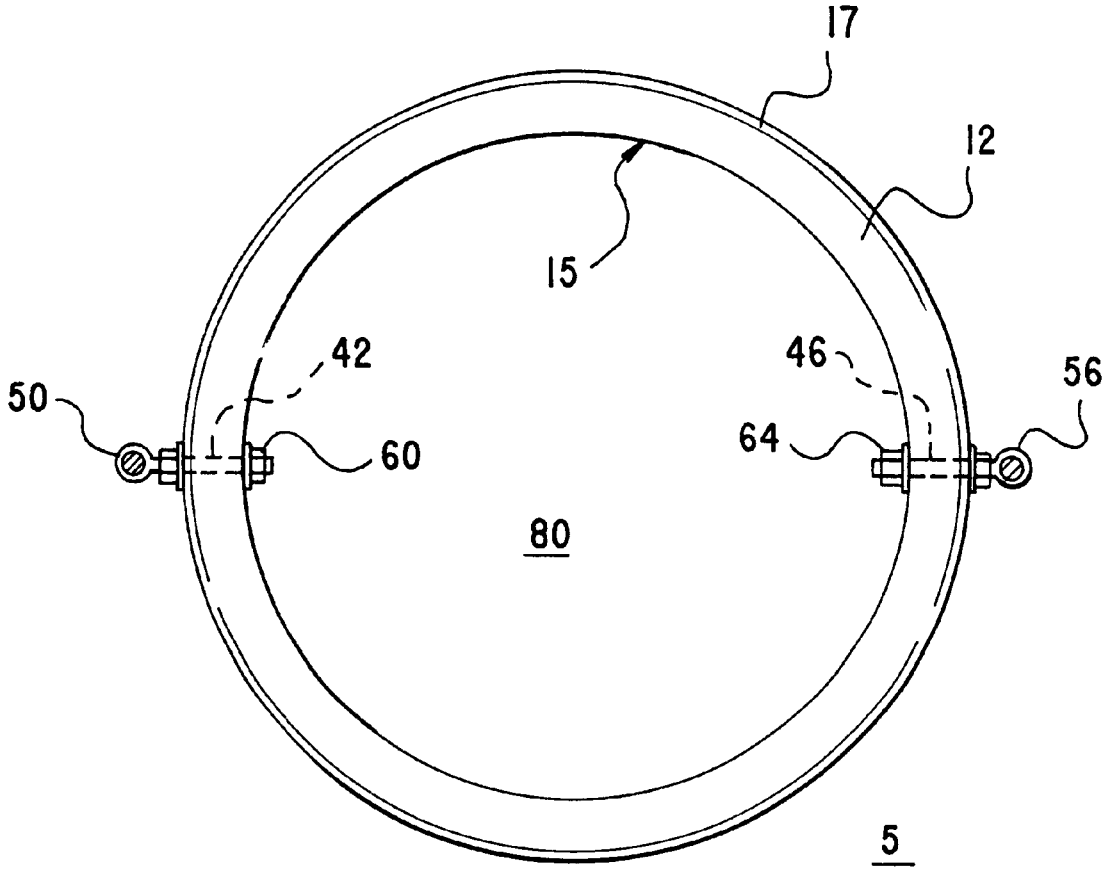
FIG. 3 is a view taken along line 3—3 of FIG. 2 of the of the portable indicating and protective structure for underground utilities.

With reference now to the drawings, a portable indicating and protective structure for underground utilities 10 is shown with salient features identified.

The portable indicating and protective structure for underground utilities includes a sidewall 12. The sidewall 12 may be cylindrical, rectangular, square or of some other geometric configuration. The sidewall 12 includes an upper opening 14 and a lower opening 80. The sidewall 12 may be corrugated. The sidewall 12 includes an exterior side 17 and an interior side 15. The sidewall 12 may include reflective strips or coatings 18 located on the exterior side 17.

The sidewall 12 includes a first aperture 42, a second aperture 44, a third aperture 46 and a fourth aperture 48. The first aperture 42 and the second aperture 44 are in vertical alignment with each other. The third aperture 46 and the fourth aperture 48 are in vertical alignment with each other. The first aperture 42 has a first ring 50 located on the exterior side 17 of the sidewall 12. The first ring 50 is secured to the sidewall 12 by a first ring securing means 60 which is connected to the first ring 50 and passes through the first aperture 42.

The second aperture 44 has a second ring 52 located on the exterior side 17 of the sidewall 12. The second ring 52 is secured to the sidewall 12 by a second ring securing means 62 which is connected to the second ring 52 and passes through the second aperture 44.

The third aperture 46 has a third ring 56 located on the exterior side 17 of the sidewall 12. The third ring 56 is secured to the sidewall 12 by a third ring securing means 64 which is connected to the third ring 56 and passes through the third aperture 46.

The fourth aperture 58 has a fourth ring located on the exterior side 17 of the sidewall 12. The fourth ring 58 is secured to the sidewall 12 by a fourth ring securing means 66 which is connected to the fourth ring 58 and passes through the fourth aperture 58.

The generic ring securing means can be any of a variety of means including threaded fasteners, bolts, and any other known method of securing a ring in a cantilevered fashion to the sidewall 12. The generic ring elements are oriented parallel to the upper opening and the lower opening of the portable indicating and protective structure for underground utilities 10.

The first ring 50 and the second ring 52 receive the first pole 20 therethrough. The first pole 20 includes a first pole upper portion 22 and a first pole lower portion 24. At the terminus of the first pole lower portion 24 a first pole spike 26 is provided. The first pole spike 26 permits the first pole 20 to penetrate the ground 5 with ease.

The third ring 56 and the fourth ring 58 receive the second pole 28 therethrough. The second pole 28 includes a second pole upper portion 30 and a second pole lower portion 32. At the terminus of the second pole lower portion 32 a second pole spike 34 is provided. The second pole spike 34 permits the second pole 28 to penetrate the ground 5 with ease.

A banner 37 is provided intermediate the first pole upper portion 22 and the second pole upper portion 30. The banner 37 includes a front side 35, a rear side 36, a right side 39 and a left side 41. The banner 36 may receive indicia 38 on the front side 35 and the rear side 36. The banner 37 may further have a reflective coating 40 provided thereon. In other embodiments the indicia 38 may be reflective or retro-reflective. The banner 37 may be affixed to the first pole 22 and the second pole 30 on its left side 41 and right side 39 respectively by any conventional and known means.

Figure 4:
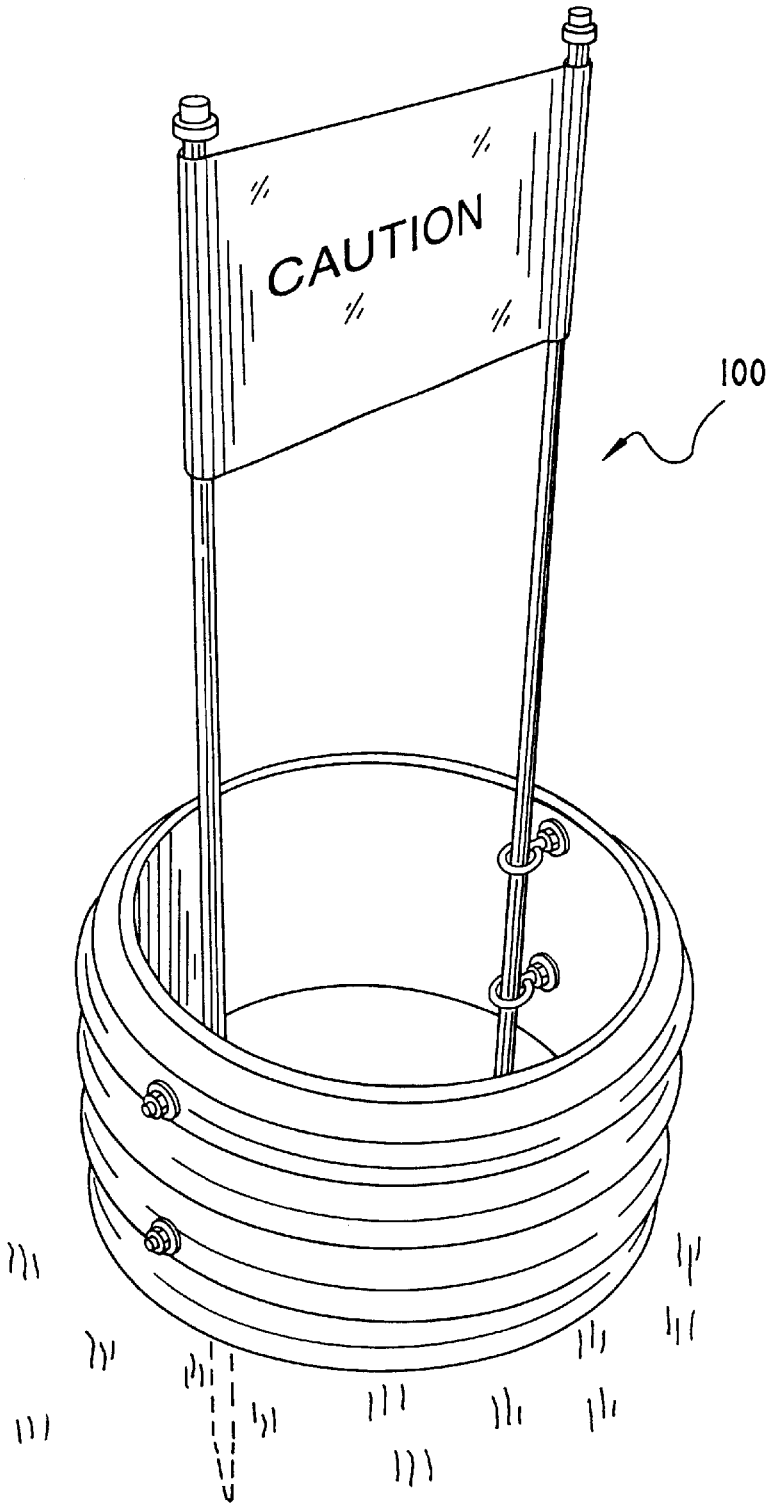
FIG. 4 is a perspective view of a second embodiment of the portable indicating and protective structure for underground utilities.

Referring now specifically to FIG. 4 a second embodiment of the portable indicating and protective structure for underground utilities 100 is shown. This embodiment is substantially the same as the first embodiment except the first, second, third and fourth rings are provided on the interior side of the sidewall as opposed to the exterior side in the first embodiment. In this fashion the first and second poles are inside the sidewall of the portable indicating and protective structure for underground utilities 100. This may be useful if there is some obstruction nearby or for other reasons.

It is apparent from the above that the present invention accomplishes all of the objectives set forth by providing a portable indicating and protective structure for underground utilities which has a barrier for surrounding a utility or other object to be protected, yet permits ease of access to that utility.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed is:

1. A portable indicating and protective structure for underground utilities including:

a sidewall, said sidewall having an upper opening and a lower opening, an exterior side and an interior side, a first pair of ring elements provided in vertical relation on said sidewall, a second pair of ring elements provided in vertical relation on said sidewall, said first pair of ring elements and said second pair of ring elements located directly opposite of each other on said sidewall, a first pole, said first pole having a first pole upper portion and said first pole having a first pole lower portion, a banner, said banner having a right side, a left side, a front side and a rear side, said banner right side secured to said first pole upper portion and said banner left side secured to said second pole upper portion, a second pole, said second pole having a second pole upper portion and said second pole having a second pole lower portion, said first pole received in said first pair of ring elements, said first pair of ring elements not being securable along the length of said first pole, said second pole received in said second pair of ring elements, said second pair of ring elements not being securable along the length of said second pole, whereby said sidewall is placed about an item to be protected, and said first pole lower portion and said second pole lower portion are placed into the ground, securing said sidewall about the item to be protected.

2. A portable indicating and protective structure for underground utilities as claimed in claim 1 wherein said banner front side and said banner rear side include indicia.

3. A portable indicating and protective structure for underground utilities as claimed in claim 1 wherein said banner front side and said banner rear side include reflective elements.

4. A portable indicating and protective structure for underground utilities as claimed in claim 1 wherein said sidewall exterior side includes reflective elements.

5. A portable indicating and protective structure for underground utilities as claimed in claim 1 wherein said sidewall is corrugated.

6. A portable indicating and protective structure for underground utilities as claimed in claim 1 wherein said sidewall is comprised of a material selected from the group consisting of plastics, woods, and metals.

7. A portable indicating and protective structure for underground utilities as claimed in claim 1 wherein said sidewall is cylindrical.

8. A portable indicating and protective structure for underground utilities as claimed in claim 1 wherein said first pair of ring elements and said second pair of ring elements are provided on said exterior side of said sidewall.

9. A portable indicating and protective structure for underground utilities as claimed in claim 1 wherein said first pair of ring elements and said second pair of ring elements are provided on said interior side of said sidewall.

10. A portable indicating and protective structure for underground utilities as claimed in claim 1 wherein said first pole lower portion and said second pole lower portion include a spike for penetrating the ground.

* * * * *